US010153567B2

(12) United States Patent
Veigel

(10) Patent No.: US 10,153,567 B2
(45) Date of Patent: Dec. 11, 2018

(54) CONNECTOR DEVICE

(71) Applicant: Andreas Veigel, Lenningen (DE)

(72) Inventor: Andreas Veigel, Lenningen (DE)

( * ) Notice: Subject to any disclaimer, the term of this patent is extended or adjusted under 35 U.S.C. 154(b) by 0 days.

(21) Appl. No.: 15/698,715

(22) Filed: Sep. 8, 2017

(65) Prior Publication Data

US 2018/0076542 A1 Mar. 15, 2018

(30) Foreign Application Priority Data

Sep. 9, 2016 (DE) ..... 20 2016 105 003 U

(51) Int. Cl.

| | |
|---|---|
| ***H01R 12/58*** | (2011.01) |
| ***H01R 13/04*** | (2006.01) |
| ***H01R 43/16*** | (2006.01) |
| *H01R 12/71* | (2011.01) |

(52) U.S. Cl.

CPC ..... *H01R 12/585* (2013.01); *H01R 13/04* (2013.01); *H01R 43/16* (2013.01); *H01R 12/716* (2013.01)

(58) Field of Classification Search

CPC ..... H01R 12/585; H01R 9/092
USPC ..... 439/82, 751
See application file for complete search history.

(56) References Cited

U.S. PATENT DOCUMENTS 4,230,384 A * 10/1980 Anhalt ..... H01R 12/585 439/81
5,482,467 A * 1/1996 Nolf ..... H01R 4/2416 439/161
5,893,779 A * 4/1999 Bianca ..... H01R 12/585 439/751
7,780,483 B1 * 8/2010 Ravlich ..... H01R 12/585 439/751
8,419,484 B2 * 4/2013 Kawai ..... H01R 12/585 439/733.1
2004/0145880 A1 * 7/2004 Watanabe ..... H01R 12/585 361/803
2005/0221687 A1 * 10/2005 Nakamura ..... H01R 12/585 439/751
2006/0264076 A1 * 11/2006 Chen ..... H01R 12/585 439/82
2007/0212907 A1 * 9/2007 Kramski ..... H01R 12/585 439/82
2007/0218717 A1 * 9/2007 Veigel ..... H01R 12/585 439/82

(Continued)

*Primary Examiner* — Gary Paumen
(74) *Attorney, Agent, or Firm* — Harness, Dickey & Pierce, P.L.C.

(57) ABSTRACT

The disclosure relates to a contact element consisting of a press-in section which is formed by two adjacently running shanks. The shanks are connected to one another in a firmly bonded manner at their upper shank ends by a connection section. The shanks run subsequently substantially parallel to one another in an upper section and then at first away from one another in a middle section and then run back onto one another again and then run parallel and adjacently again in a lower section and are again connected to one another in a firmly bonded manner at their other end on the insertion side by an introductory section. At the transition of the connection section to the upper section the interval A of the two shanks is greater at least in a partial area, preferably over the entire thickness in the direction transverse to the previously cited direction of width of the contact element than the interval in the upper section.

11 Claims, 2 Drawing Sheets

(56) References Cited

U.S. PATENT DOCUMENTS

| | | | | |
|---|---|---|---|---|
| 2009/0023310 | A1* | 1/2009 | Thiel | H01R 12/585 439/66 |
| 2009/0104823 | A1* | 4/2009 | Ludwig | H01R 12/585 439/857 |
| 2014/0118973 | A1* | 5/2014 | Nastasa | H01R 12/585 361/760 |
| 2014/0213080 | A1* | 7/2014 | Miyake | H01R 12/585 439/82 |
| 2015/0011132 | A1* | 1/2015 | Shibuya | H01R 13/03 439/887 |
| 2015/0311660 | A1* | 10/2015 | Onishi | H01R 43/205 29/747 |

* cited by examiner

Direction of width
1
21
31
51
40
41
30
42
10
20
43
22
32
50

BGES
30
20
Bs1
Bs2
51
A
50

CONNECTOR DEVICE

CROSS-REFERENCE TO RELATED APPLICATIONS

This application claims the benefit and priority of German Application No. 20 2016 105 003.0, filed Sep. 9, 2017. The entire disclosure of the above application is incorporated herein by reference.

FIELD

The disclosure relates to a plug-and-socket connector. The disclosure relates in particular to a printed circuit board plug-and-socket connector for the direct plugging into a bore or a substantially round contact zone in a printed circuit board for establishing a printed circuit board plug-and-socket connection.

BACKGROUND

This section provides background information related to the present disclosure which is not necessarily prior art.

Expensive tools with precisely set dimensions are required in known contacts for the connection to printed circuit boards such as press-in contacts. Press-in contacts are known from several publications, e.g. EP 0 451 674 A or DE 36 23 453 A. One of the significant disadvantages of such solutions is the fact that, as previously explained, the tools for the manufacturing are very expensive and are furthermore not flexible as regards their dimensions, which for its part conditions an expensive development for achieving the optimal final dimension of the press-in contact.

Furthermore, it is disadvantageous for various usages and very small contacts if the originally available contact cross section is often reduced by free stampings and as a consequence the current-carrying capacity and the mechanical stability are reduced or appropriately larger hole diameters must be selected.

A press-in contact and a method for manufacturing a press-in contact are known from WO 2005 122 337 A1. The known press-in contact comprises a contact body and two shanks formed in one piece with it and are formed by non-cutting working, wherein a separating procedure and a widening are provided in order to form a press-in area. The two shanks form a tip at which a separating gap is provided.

DE 202 18 295 U1 discloses a contact element for printed circuit boards with a pin part for being pressed into a bore of the printed circuit board and which comprises two approximately parallel arms constructed in such a manner that they can be moved against one another counter to a return force.

DE 102013103818 A1 relates to a method for manufacturing pressed-in contacts of a stamped contour with a connection body into shanks connected to the latter which are arranged facing one another, wherein the shanks comprise press-in areas and end areas facing away from the connection body and with contact sections which face each other and/or at a distance from each other in a defined manner and relates to the deforming of the shanks comprising moving the end areas of the shanks onto one another with at least a partial plastic deformation of at least one of the shanks, wherein the contact sections of the shanks touch one another in a defined manner at least in sections after a removal of the load.

Various other press-in connections are sufficiently known in the prior art and are suitable in particular for producing electrical contacts with low transitional resistances. The connections can be rapidly and economically manufactured and can guarantee a high degree of reliability and a long service life-provided that they have the correct design, manufacture and assembly. It is known to provide press-in contacts with deformable shape elements which deform in a most defined manner possible during the mounting of the contact and which should have a certain contact force or holding force.

E.g., firmly bonded methods, for example soldered connections can be at least partially substituted by press-in connections. Press-in connections can usually be produced while forming a non-positive component as well as a positive component. At least minimal deformations can result during the press-in contact and/or the associated reception of contact which can contribute to an increase in the holding force and an enlargement of the contact surface. However, it turned out that known press-in contacts can have tolerance variations and various problems in practice conditioned by the manufacture which for their part can be expressed in large dispersions during mounting forces and/or in contact forces of the joined connections. This can result on the one hand in that no sufficiently large contact force can be generated so that the desired reliability of the connection is not present. Furthermore, the magnitudes of the contacts conditioned by the manufacture cannot be scaled as desired so that compact structural shapes cannot be readily realized.

SUMMARY

This section provides a general summary of the disclosure, and is not a comprehensive disclosure of its full scope or all of its features.

Given this background, the present disclosure makes available an improved contact, especially an improved press-in contact which can also be manufactured as a small, compact structural shape and which has good mounting and contacting qualities. Furthermore, the present disclosure has the idea of suggesting a method for manufacturing such contacts.

A basic concept of the present disclosure consists of the specific geometric design of two contact shanks which are connected preferably at their plug-side end to one another in a firmly bonded and/or material-fit manner.

Another aspect relates to the contact shanks, which run substantially parallel and adjacent to one another with an upper section, a middle section to which these contact shanks run at first in a diverging manner and then again to one another in order to then run in parallel adjacently again in a lower section and which are connected to one another on their insertion-side end in a firmly bonded manner by an introductory section.

It is especially advantageous here at the transition of the connecting section of the contact element to the upper section that the interval of the two shanks is greater at least in a partial area, preferably over the entire thickness in the direction transverse to the previously cited width direction of the contact element than the interval in the following, upper section.

An especially advantageous embodiment of the disclosure provides that the interval of the two shanks at the transition of the two shanks from the lower section to the introductory section is greater at least in a partial area, preferably over the entire thickness in the direction transverse to the previously cited width direction of the contact element than the interval in the following, upper section.

This can be achieved in that widened-out areas or openings which are preferably shaped like a hairpin or an eyelet are provided on the upper and/or lower section of the press-in contact, therefore on the transition between the contact shanks and the particular massive part of the press-in contact (i.e., on the transition to the connecting section and/or on the transition to the introductory section). These widened-out areas advantageously run over the entire thickness of the contact element, so to say from a front side flank to the opposite, rear side flank between the contact elements. Alternatively, the particular eyelet-shaped widened-out area can also be impressed or partially impressed on or in the entry area on the side flanks of the contact element.

Therefore, it is advantageous according to the disclosure if an eyelet-shaped opening like the one previously cited is present on the transition of the two shanks from the lower section to the introductory section, which opening can be seen at least in a sectional plane or grinding plane through the contact element and an eyelet-shaped opening is also present or is formed on the transition of the connection section to the upper section which opening can be seen at least in a sectional plane or grinding plane through the contact element.

Another advantageous embodiment of the disclosure provides that the sum of the width $B_{GES}$ of the two shanks, formed from the width $B_{S1}$ of the one shank in the direction of width and of the width $B_{S2}$ of the other shank measured in the same direction of width, namely, in the direction of the contact element in which it has its maximal width, is equal to or almost equal to the width of the contact element in the area of the transition to the connection section and/or in the area of the transition to the introductory section of the contact.

Furthermore, it is advantageous if the shanks in the upper section in which they completely rest run adjacent and parallel to one another and rest on one another at least in sections or completely, namely, with the inner sides of the shanks which sides are directly opposite and limit the slot between the shanks. A possible advantageous embodiment of the disclosure provides that the width of each shank is constant in the course from the connection section to the introductory section.

Alternatively, it can also be provided that the shanks in this area, in which they run substantially in parallel, run at an interval from each other while forming a slot, as a result of which the spring length of the shanks becomes longer on the whole, which improves the elasticity and reduces the press-in force for pressing in.

Furthermore, it is advantageous if the shanks in the lower section, in which they run parallel to one another, rest on one another at least in sections or completely, or also run at an interval from one another while forming a slot.

Another advantageous embodiment of the disclosure comprises a contact arrangement consisting of a contact element as previously described and of a printed circuit board or a contacting plate with a thickness $D_L$ with a contact zone for the contact element, wherein in the inserted state of the contact element into the contact zone the contact element projects with its introductory section out of the bottom of the printed circuit board, preferably with a length of approximately 0.5 to 2 mm (for testing purposes).

Other preferred embodiments provide that the shanks in a lower or upper partial section in the widened-out area of the two shanks are constructed opposite an upper or lower partial section inside the widened-out area with a greater shank width and/or a greater effective cross-sectional surface of the shanks.

It furthermore proved to be advantageous if the edge radii of the outer edges of the two shanks are designed to be larger in the lower introductory area than in the middle, i.e., widened-out contacting area.

Other details, modifications and advantages of the invention result from the following description of a preferred exemplary embodiment with reference made to the drawings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figures 1, 2, 3, 4:
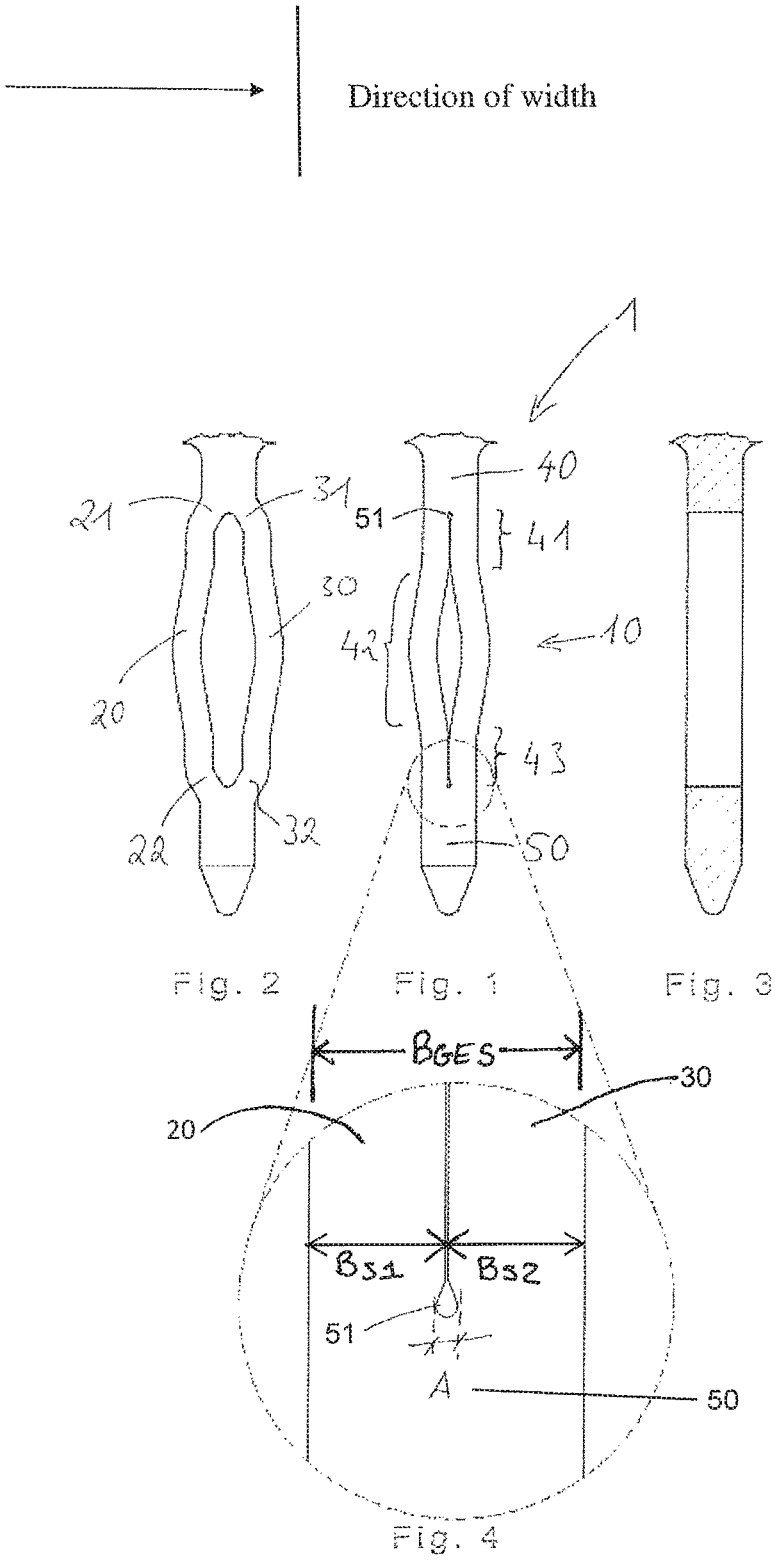
FIG. 1 shows a contact element according to the disclosure in a first view.
FIG. 2 shows a contact element according to the disclosure in a second view with shanks widened out in comparison to FIG. 1.
FIG. 3 shows a side view of the contact element from FIG. 1.
FIG. 4 shows a detailed view from FIG. 1.

Example embodiments will now be described more fully with reference to the accompanying drawings.

The disclosure is explained in detail in the following with reference made to the FIGS. 1 to 8, wherein the same reference numerals refer to the same functional and/or structural features.

An exemplary embodiment of a contact element 1 consisting of a press-in section 10 formed by two shanks 20, 30 running adjacent to each other is shown in FIGS. 1 to 4. The shanks 20, 30 are connected to one another in a firmly bonded manner at their upper shank ends 21, 31 by a connection section 40. They subsequently run (in the sequence to the plug-side end) parallel to one another in an upper section 41 and then at first away from one another in a middle section 42.

The shanks 20, 30 then run back toward one another and then run in parallel and adjacent to one another again in a lower section 43.

On their other, insertion-side end 22, 32 of the shanks 20, 30 they are connected to each other again in a firmly bonded manner by an introductory section 50.

At the transition of the connecting section 40 to the upper section 41 the interval A of the two shanks 20, 30 is greater over the entire thickness in the direction transverse to the previously cited width direction of the contact element 1 than the interval in the following, upper section 41.

The interval of the two shanks 20, 30 at the transition of the two shanks from the lower section 43 to the introductory section 50 is greater in a partial area over the entire thickness in the direction transverse to the previously cited width direction of the contact element than the interval in the following, upper section 42.

An eyelet-shaped opening 51 (see FIG. 4) which can be seen at least in a sectional plane or grinding plane through the contact element 1 is located at the transition of the two shanks 20, 30 from the lower section 43 to the introductory section 50. In the present exemplary embodiment the eyelet-shaped opening 51 runs in the transitional areas between the shanks 20, 30 and the following sections of the contact element 1, as shown by way of example in FIG. 4. To this extent an eyelet-shaped opening 51 which can be seen at least in a sectional plane or grinding plane through the contact element 1 is also located at the transition of the connection section 40 to the upper section 41.

The corresponding opening is characterized in that the width of the opening in the direction of width is greater than the width of the directly following slot in this area.

The sum of the width $B_{GES}$ of the two shanks 20, 30, formed from the width $B_{S1}$ of the one shank 20 and of the width $B_{S2}$ in the direction of width and of the width $B_{S2}$ of the other shank 30 measured in the direction of the contact element 1 in which it has its maximal width, is equal to or almost equal to the width of the contact element 1 in the area of the connection section 40 and also of the introductory section 50.

Furthermore, it is apparent in FIG. 1 that the sum of the width $B_{GES}$ of the two shanks 20, 30, formed from the width $B_{S1}$ of the one shank 20 and of the width $B_{S2}$ of the other shank 30 measured in the direction of the contact element 1 in which it has its maximal width, is also almost equal to the width of the contact element 1 in the area of the upper and lower section 41, 43 in which the shanks 20, 30 run substantially parallel and resting on one another while forming a separation slot. Consequently, the shanks 20, 30 run in the upper section 41 and the lower section 43 resting on one another and in a parallel manner at least in sections.

FIG. 2 shows the state of the process in which the contact element 1 was obtained by stamping with a stamping tool, wherein the shanks 20, 30 are widened out relative to the state in FIG. 1 since the area between the shanks 20, 30 was freely stamped by the stamping stamp. However, in the state according to FIG. 2 and also according to FIG. 1, sectional breaks or stamping seam edges can be recognized on the inner flanks of the shanks 20, 30 which are typically produced during stamping. In another step which takes place after the stamping, the contact element 1 is deformed into the state shown in FIG. 1.

Exemplary embodiments of a contact element 1 consisting of a press-in section 10 formed by two shanks 20, 30 running adjacent to each other is shown in FIGS. 5 to 8. The shanks 20, 30 are also connected here to one another in a firmly bonded manner at their upper shank ends 21, 31 by a connection section 40. They subsequently run (in the sequence to the plug-side end) substantially parallel to one another in an upper section 41 and then at first away from one another in a middle section 42.

Figure 5:
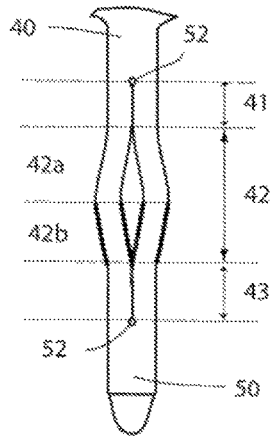
FIGS. 5-8 show another alternative exemplary embodiment of a contact element.

In the embodiment according to FIG. 5 the shanks are constructed in a lower partial section 42*b* in the widened-out area of the two shanks 20, 30 opposite an upper partial section 42*a* inside the widened-out area with a greater shank width (viewed in the direction of width B), which results in an increase of the bending force in the lower area.

In the present examples the separation of the upper and the lower partial sections 42*a*, 42*b* runs approximately in the center of the widened-out area 42.

Figure 6:
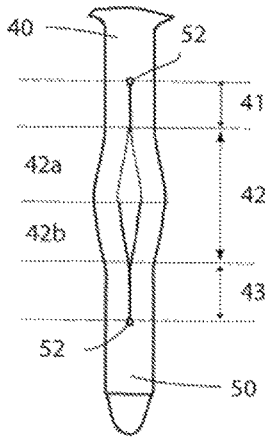

In the embodiment according to FIG. 6 the shanks are constructed in an upper partial section 42*a* in the widened-out area of the two shanks 20, 30 opposite a lower partial section 42*a* inside the widened-out area with a greater shank width (viewed in the direction of width B), which results in an increase of the bending force in the lower area.

Figure 8:
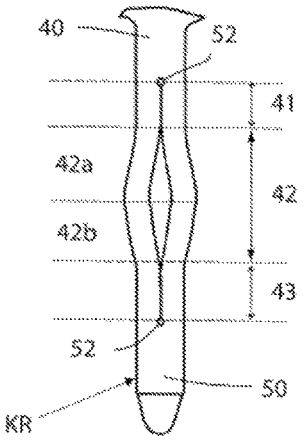

It furthermore proved to be advantageous, as is indicated with the arrow KR in FIG. 8, if the edge radii KR of the outer edges of the two shanks 20, 30 are designed to be larger in the lower introductory area 50 leading to the contacting area 42 than in the otherwise middle, i.e., widened-out contacting area 42.

Figure 7:
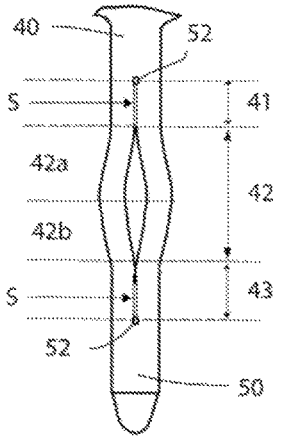

FIG. 7 shows an embodiment in which the shanks 20, 30 in the areas 41, 43, in which the shanks run substantially in parallel, run at an interval from each other while forming a slot S, as a result of which the spring length of the shanks 20, 30 becomes longer on the whole, which improves the elasticity and reduces the press-in force for pressing in.

However, the disclosure is not limited in its design to the previously indicated preferred exemplary embodiment. Rather, a plurality of variants and types of embodiments are conceivable which make use of the solution shown and of the method shown even in the case of a basically different type of embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A contact element comprising:

a press-in section formed by two adjacently running shanks, the shanks are connected to one another in a firmly bonded manner at an upper shank end by a connection section;

the shanks run subsequently substantially parallel to one another in an upper section and then at first away from one another in a middle section and then run back onto one another again and then run parallel and adjacently again in a lower section;

the shanks are again connected to one another in a firmly bonded manner at another end on the insertion side by an introductory section; and an interval A is formed at a transition of the connection section to the upper section of the two shanks, the interval A has an area greater than an area of an interval in the upper section, the areas determined over an entire thickness in a direction transverse to a width of the contact element.

2. The contact element according to claim 1, wherein the interval of the two shanks at the transition of the two shanks from the lower section to the introductory section is greater in a partial area, preferably over the entire thickness in the direction transverse to the width direction of the contact element, than the interval in the upper section.

3. The contact element according to claim 1, wherein an eyelet-shaped opening which can be seen at least in a sectional plane or grinding plane through the contact element is located at the transition of the two shanks from the lower section to the introductory section.

4. The contact element according to claim 1, wherein an eyelet-shaped opening which can be seen at least in a sectional plane or grinding plane through the contact element is located at the transition of the connecting section to the upper section.

5. The contact element according to claim 1, wherein a sum of a width $B_{GES}$ of the two shanks, formed from a width $B_{S1}$ of the one shank and of a width $B_{S2}$ of the other shank measured in a direction of the contact element in which it has its maximal width, is equal to or almost equal to a width of the contact element.

6. The contact element according to claim 1, wherein the shanks in the upper section or in the lower section in which they run parallel to one another, rest on one another at least in sections or completely.

7. The contact element according to claim 1, wherein the shanks run in areas in which the shanks run at an interval from each other while forming a slot.

8. The contact element according to claim 1, wherein the shanks are constructed in a lower partial section in a widened-out area of the two shanks opposite an upper partial section inside the widened-out area with a greater shank width viewed in the direction of width.

9. The contact element according to claim 2, wherein the shanks are constructed in a lower partial section in a widened-out area of the two shanks opposite an upper partial section inside the widened-out area with a greater shank width viewed in the direction of width.

10. The contact element according to claim 1, wherein an edge radii KR of the outwardly facing edges of the two shanks are designed to be larger in the lower introductory area leading to the contacting area than in the middle, widened-out area.

11. A contact element comprising:

a press-in section formed by two adjacently running shanks, the shanks are connected to one another in a firmly bonded manner at an upper shank end by a connection section;

the shanks run subsequently substantially parallel to one another in an upper section and then at first away from one another in a middle section and then run back onto one another again and then run parallel and adjacently again in a lower section;

the shanks are again connected to one another in a firmly bonded manner at another end on the insertion side by an introductory section; and an interval A is formed at a transition of the connection section to the upper section of the two shanks, the interval A has an area greater than an area of the interval in the upper section, the areas are determined over an entire thickness in a direction transverse to a width of the contact element; and a sum of a width $B_{GES}$ of the two shanks, formed from a width $B_{S1}$ of the one shank and of a width $B_{S2}$ of the other shank measured in a direction of the contact element where it has its maximal width, is equal to or almost equal to a width of the contact element.

* * * * *